US008328072B2

(12) United States Patent
Goshgarian et al.

(10) Patent No.: US 8,328,072 B2
(45) Date of Patent: Dec. 11, 2012

(54) METHOD FOR FORMING A WAVE FORM USED TO MAKE WOUND STENTS

(75) Inventors: Justin Goshgarian, Santa Rosa, CA (US); Erik Griswold, Penngrove, CA (US)

(73) Assignee: Medtronic Vascular, Inc., Santa Rosa, CA (US)

( * ) Notice: Subject to any disclaimer, the term of this patent is extended or adjusted under 35 U.S.C. 154(b) by 400 days.

(21) Appl. No.: 12/838,778

(22) Filed: Jul. 19, 2010

(65) Prior Publication Data

US 2012/0012014 A1 Jan. 19, 2012

(51) Int. Cl.
*B23K 31/02* (2006.01)
*B21D 28/00* (2006.01)

(52) U.S. Cl. ..... 228/101; 228/145; 228/170; 72/326; 72/338

(58) Field of Classification Search ..... None
See application file for complete search history.

(56) References Cited

U.S. PATENT DOCUMENTS

| | | | | | |
|---|---|---|---|---|---|
| 1,433,138 | A | * | 10/1922 | Kruse | 83/426 |
| 2,153,936 | A | | 4/1939 | Owens et al. | |
| 2,868,236 | A | * | 1/1959 | Smith | 140/71 R |
| 2,874,731 | A | * | 2/1959 | Smith | 140/71 R |
| 3,185,185 | A | | 5/1965 | Pfund | |
| 4,047,544 | A | | 9/1977 | Seaborn et al. | |
| 4,886,062 | A | | 12/1989 | Wiktor | |
| 4,919,403 | A | * | 4/1990 | Bartholomew | 267/165 |
| 5,019,090 | A | | 5/1991 | Pinchuk | |
| 5,032,948 | A | * | 7/1991 | Klepel | 361/220 |
| 5,092,877 | A | | 3/1992 | Pinchuk | |
| 5,133,732 | A | | 7/1992 | Wiktor | |
| 5,226,913 | A | | 7/1993 | Pinchuk | |
| 5,304,200 | A | | 4/1994 | Spaulding | |
| 5,314,472 | A | | 5/1994 | Fontaine | |
| 5,324,472 | A | | 6/1994 | Page et al. | |
| 5,370,683 | A | | 12/1994 | Fontaine | |
| 5,443,498 | A | | 8/1995 | Fontaine | |
| 5,527,354 | A | | 6/1996 | Fontaine et al. | |
| 5,549,663 | A | | 8/1996 | Cottone, Jr. | |
| 5,653,727 | A | | 8/1997 | Wiktor | |
| 5,716,396 | A | | 2/1998 | Williams, Jr. | |
| 5,789,050 | A | * | 8/1998 | Kang | 428/42.3 |
| 5,824,043 | A | * | 10/1998 | Cottone, Jr. | 623/1.13 |
| 5,895,406 | A | | 4/1999 | Gray et al. | |
| 5,902,266 | A | | 5/1999 | Leone et al. | |
| 5,913,897 | A | | 6/1999 | Corso, Jr. et al. | |
| 6,042,597 | A | | 3/2000 | Kveen et al. | |
| 6,056,187 | A | * | 5/2000 | Acciai et al. | 228/173.5 |
| 6,117,165 | A | | 9/2000 | Becker | |

(Continued)

FOREIGN PATENT DOCUMENTS

| | | |
|---|---|---|
| EP | 945107 | 9/1999 |

(Continued)

*Primary Examiner* — Kiley Stoner

(57) ABSTRACT

A method for forming a wave form for a stent. The wave form includes a plurality of substantially straight portions and a plurality of curved portions. Each curved portion connects adjacent substantially straight portions. The method includes feeding a formable material between a first die and a second die, the first die having a protruding surface in the shape of the wave form, and the second die having a recessed surface in the shape of the wave form complementing the protruding surface of the first die, pressing the formable material with the protruding surface of the first die into contact with the recessed surface of the second die, and shearing the wave form from the formable material with shearing forces created by the pressing.

16 Claims, 8 Drawing Sheets

U.S. PATENT DOCUMENTS

| | | | | |
|---|---|---|---|---|
| 6,136,023 | A | 10/2000 | Boyle | |
| 6,190,406 | B1 | 2/2001 | Duerig et al. | |
| 6,203,569 | B1 | 3/2001 | Wijay | |
| 6,342,067 | B1 | 1/2002 | Mathis et al. | |
| 6,355,059 | B1 | 3/2002 | Richter et al. | |
| 6,423,091 | B1 | 7/2002 | Hojeibane | |
| 6,432,132 | B1 | 8/2002 | Cottone et al. | |
| 6,447,540 | B1 | 9/2002 | Fontaine et al. | |
| 6,503,270 | B1 | 1/2003 | Richter et al. | |
| 6,610,086 | B1 | 8/2003 | Kock et al. | |
| 6,656,219 | B1 | 12/2003 | Wiktor | |
| 6,730,117 | B1 | 5/2004 | Tseng et al. | |
| 6,736,844 | B1 | 5/2004 | Glatt et al. | |
| 6,878,162 | B2 | 4/2005 | Bales et al. | |
| 6,923,828 | B1 | 8/2005 | Wiktor | |
| 6,969,402 | B2 | 11/2005 | Bales et al. | |
| 7,004,968 | B2 | 2/2006 | Lootz et al. | |
| 7,108,714 | B1 | 9/2006 | Becker | |
| 7,169,175 | B2 | 1/2007 | Cottone, Jr. et al. | |
| 7,329,277 | B2 | 2/2008 | Addonizio et al. | |
| 2002/0095208 | A1 | 7/2002 | Gregorich et al. | |
| 2003/0083736 | A1 | 5/2003 | Brown et al. | |
| 2004/0044401 | A1 | 3/2004 | Bales et al. | |
| 2004/0143318 | A1 | 7/2004 | Tseng et al. | |
| 2006/0030934 | A1 | 2/2006 | Hogendijk et al. | |
| 2006/0079955 | A1 | 4/2006 | Brown | |
| 2007/0029073 | A1* | 2/2007 | Teshima et al. | 165/109.1 |
| 2008/0097580 | A1 | 4/2008 | Dave | |
| 2008/0097582 | A1 | 4/2008 | Shanley et al. | |
| 2008/0183273 | A1 | 7/2008 | Mesana et al. | |
| 2008/0288053 | A1 | 11/2008 | Addonizio et al. | |
| 2008/0289389 | A1 | 11/2008 | Fitch et al. | |
| 2008/0294241 | A1 | 11/2008 | Addonizio et al. | |
| 2008/0306583 | A1 | 12/2008 | Bashiri et al. | |
| 2008/0319529 | A1 | 12/2008 | Krivoruchko et al. | |
| 2008/0319534 | A1* | 12/2008 | Birdsall et al. | 623/1.22 |
| 2008/0319535 | A1 | 12/2008 | Craven et al. | |
| 2009/0005848 | A1 | 1/2009 | Strauss et al. | |
| 2009/0024207 | A1 | 1/2009 | Addonizio et al. | |
| 2009/0036976 | A1 | 2/2009 | Beach et al. | |
| 2010/0274345 | A1* | 10/2010 | Rust | 623/1.13 |
| 2010/0274350 | A1* | 10/2010 | Richter | 623/1.22 |
| 2010/0280593 | A1* | 11/2010 | Richter | 623/1.16 |
| 2011/0015721 | A1* | 1/2011 | Tseng et al. | 623/1.16 |
| 2011/0067471 | A1* | 3/2011 | Griswold | 72/135 |
| 2011/0071615 | A1* | 3/2011 | Griswold | 623/1.15 |
| 2011/0071617 | A1* | 3/2011 | Baldwin et al. | 623/1.16 |
| 2011/0071618 | A1* | 3/2011 | Baldwin et al. | 623/1.16 |
| 2011/0071620 | A1* | 3/2011 | Bliss et al. | 623/1.16 |
| 2011/0218614 | A1* | 9/2011 | Lam | 623/1.15 |
| 2011/0218615 | A1* | 9/2011 | Griswold | 623/1.15 |
| 2011/0241039 | A1* | 10/2011 | Liao | 257/91 |
| 2011/0257724 | A1* | 10/2011 | Kantor | 623/1.15 |
| 2012/0029626 | A1* | 2/2012 | Savage et al. | 623/1.42 |
| 2012/0060348 | A1* | 3/2012 | Chambers et al. | 29/505 |

FOREIGN PATENT DOCUMENTS

| | | |
|---|---|---|
| EP | 1155664 | 11/2007 |
| GB | 2281865 | 3/1995 |
| WO | WO2007/095466 | 8/2007 |
| WO | WO2008/028964 | 3/2008 |
| WO | WO2008/100783 | 8/2008 |

* cited by examiner

METHOD FOR FORMING A WAVE FORM USED TO MAKE WOUND STENTS

BACKGROUND OF THE INVENTION

1. Field of the Invention

The present invention is generally related to a method for forming a wave form for a stent and a method for manufacturing a stent.

2. Background of the Invention

A stent is typically a hollow, generally cylindrical device that is deployed in a body lumen from a radially contracted configuration into a radially expanded configuration, which allows it to contact and support a vessel wall. A plastically deformable stent can be implanted during an angioplasty procedure by using a balloon catheter bearing a compressed or "crimped" stent, which has been loaded onto the balloon. The stent radially expands as the balloon is inflated, forcing the stent into contact with the body lumen, thereby forming a support for the vessel wall. Deployment is effected after the stent has been introduced percutaneously, transported transluminally, and positioned at a desired location by means of the balloon catheter.

Stents may be formed from wire(s) or strip(s) of material, may be cut from a tube, or may be cut from a sheet of material and then rolled into a tube-like structure. While some stents may include a plurality of connected rings that are substantially parallel to each other and are oriented substantially perpendicular to a longitudinal axis of the stent, others may include a helical coil that is wrapped or wound around a mandrel aligned with the longitudinal axis at a non-perpendicular angle.

Stent designs that are comprised of wound materials generally have complex geometries so that the final stents may be precisely formed. The small size and complexity of some stent designs generally makes its formation difficult. Wound stents are formed such that when unsupported, they create the desired stent pattern and vessel support. This process generally involves winding a source material around a supporting structure such as a rod or mandrel and creating a helical or spring-like wrap pattern. To provide greater support, along this wrapped element, geometries are formed into the source material to better support the tissue in between each wrap, usually of sinusoidal nature.

SUMMARY OF THE INVENTION

According to an aspect of the present invention, there is provided a method for forming a wave form for a stent. The wave form includes a plurality of substantially straight portions and a plurality of curved portions. Each curved portion connects adjacent substantially straight portions. The method includes feeding a formable material between a first die and a second die, the first die having a protruding surface in the shape of the wave form, and the second die having a recessed surface in the shape of the wave form complementing the protruding surface of the first die, pressing the formable material with the protruding surface of the first die into contact with the recessed surface of the second die, and shearing the wave form from the formable material with shearing forces created by the pressing.

According to an aspect of the present invention, there is provided a method for manufacturing a stent. The method includes forming a wave form for a stent. The wave form includes a plurality of substantially straight portions and a plurality of curved portions. Each curved portion connects adjacent substantially straight portions. The forming includes feeding a formable material between a first die and a second die, the first die having a protruding surface in the shape of the wave form, and the second die having a recessed surface in the shape of the wave form complementing the protruding surface of the first die, pressing the formable material with the protruding surface of the first die into contact with the recessed surface of the second die, and shearing the wave form from the formable material with shearing forces created by the pressing. The method also includes wrapping the wave form around a mandrel at an angle to form a helix comprising a plurality of turns, and connecting selected curved portions of the wave form in adjacent turns of the helix.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF EMBODIMENTS OF THE INVENTION

The following detailed description is merely exemplary in nature and is not intended to limit the invention or the application and use of the invention. Furthermore, there is no intention to be bound by any expressed or implied theory presented in the preceding technical field, background, brief summary or the following detailed description.

Figure 1:
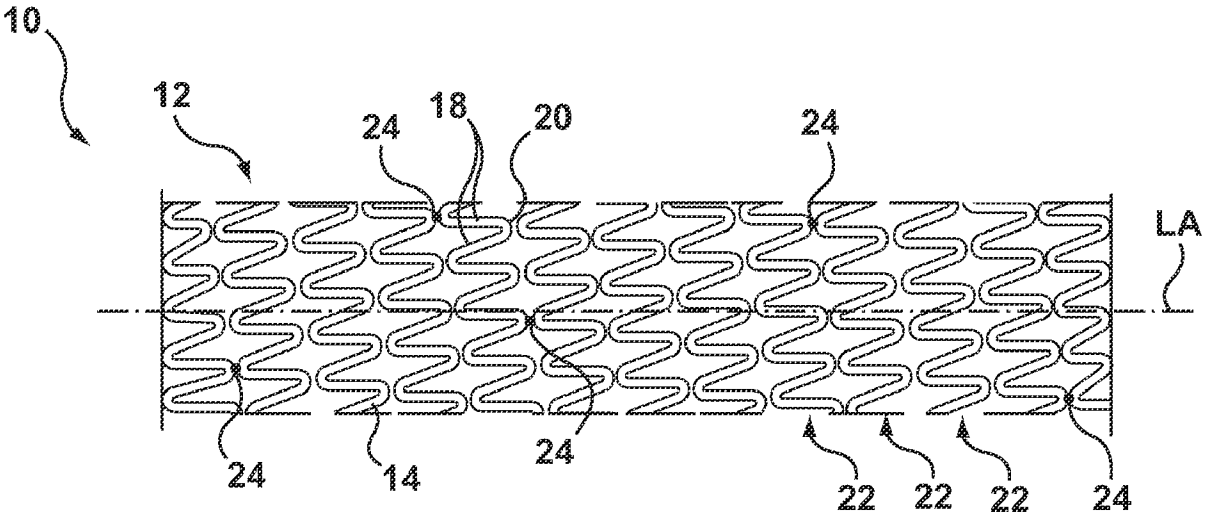
FIG. 1 is a schematic view of a stent.

FIG. 1 schematically illustrates a stent 10 that has been manufactured according to an embodiment of the present invention. The stent 10 is generally cylindrical in shape and has a longitudinal axis LA extending through the center of the stent 10. The stent 10 includes a continuous wave form 12 that is formed from a formable material 14 using a forming apparatus 100, 200 (illustrated schematically in FIGS. 4 and 8) according to embodiments of the present invention, as discussed in further detail below.

Figure 2:
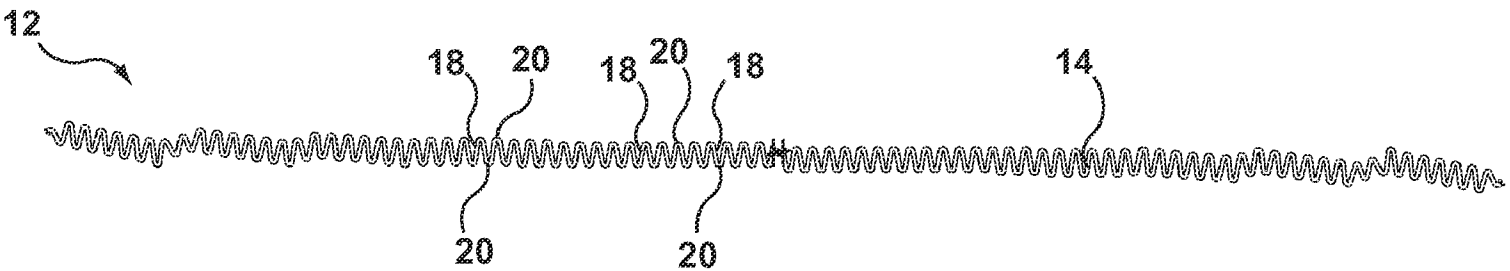
FIG. 2 is a schematic view of a wave form before the wave form is wound into the stent of FIG. 1.

As illustrated in FIG. 2, the wave form 12 may be formed so that the wave form 12 includes a plurality of struts 18 and a plurality of crowns 20. Each crown 20 is a curved portion or turn within the wave form 12 that connects adjacent struts 18 to define the continuous wave form 12. As shown in FIG. 2, the struts 18 are substantially straight portions of the wave form 12. In other embodiments, the struts 18 may be slightly bent or have other shapes, such as a sinusoidal wave, for example. The illustrated embodiment is not intended to be limiting in any way.

Figure 3:
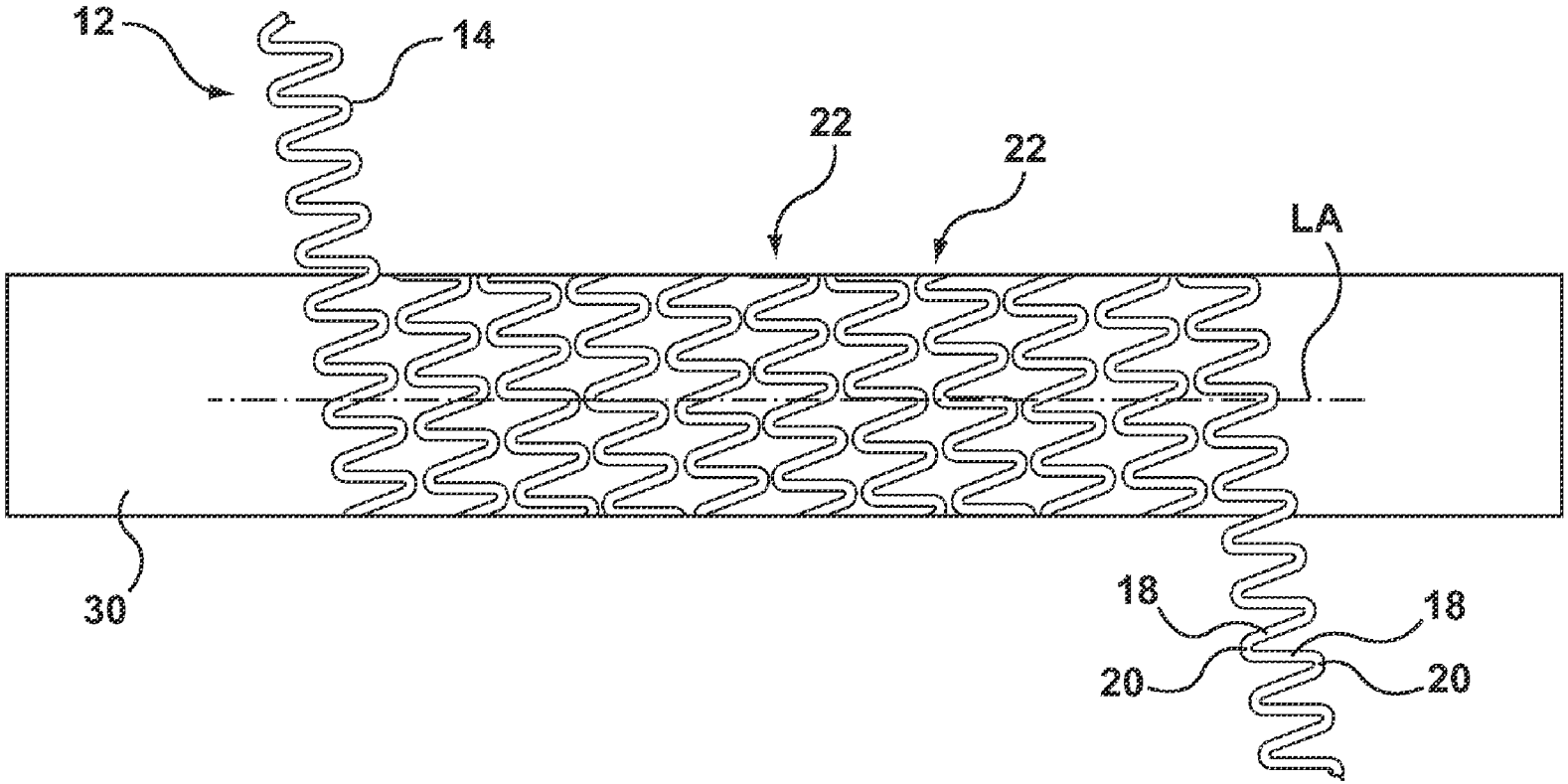
FIG. 3 is a schematic view of the wave form of FIG. 2 being wrapped around a mandrel.

After the wave form 12 has been formed by the forming apparatus 100, 200, the wave form 12 may be wrapped, at a pitch, around a mandrel 30 that has a longitudinal axis that will coincide with the longitudinal axis LA of the stent 10, so as to form a helix having multiple turns 22, as illustrated in FIG. 3. After the helix has been formed, select crowns 20 of adjacent turns 22 may be connected together, as represented by connections 24 illustrated in FIG. 1. The connections 24 may be formed by fusing the select crowns 20 together, by welding the select crowns 20 together, or by using any other suitable method to connect portions of adjacent turns 22 together.

Figure 4:
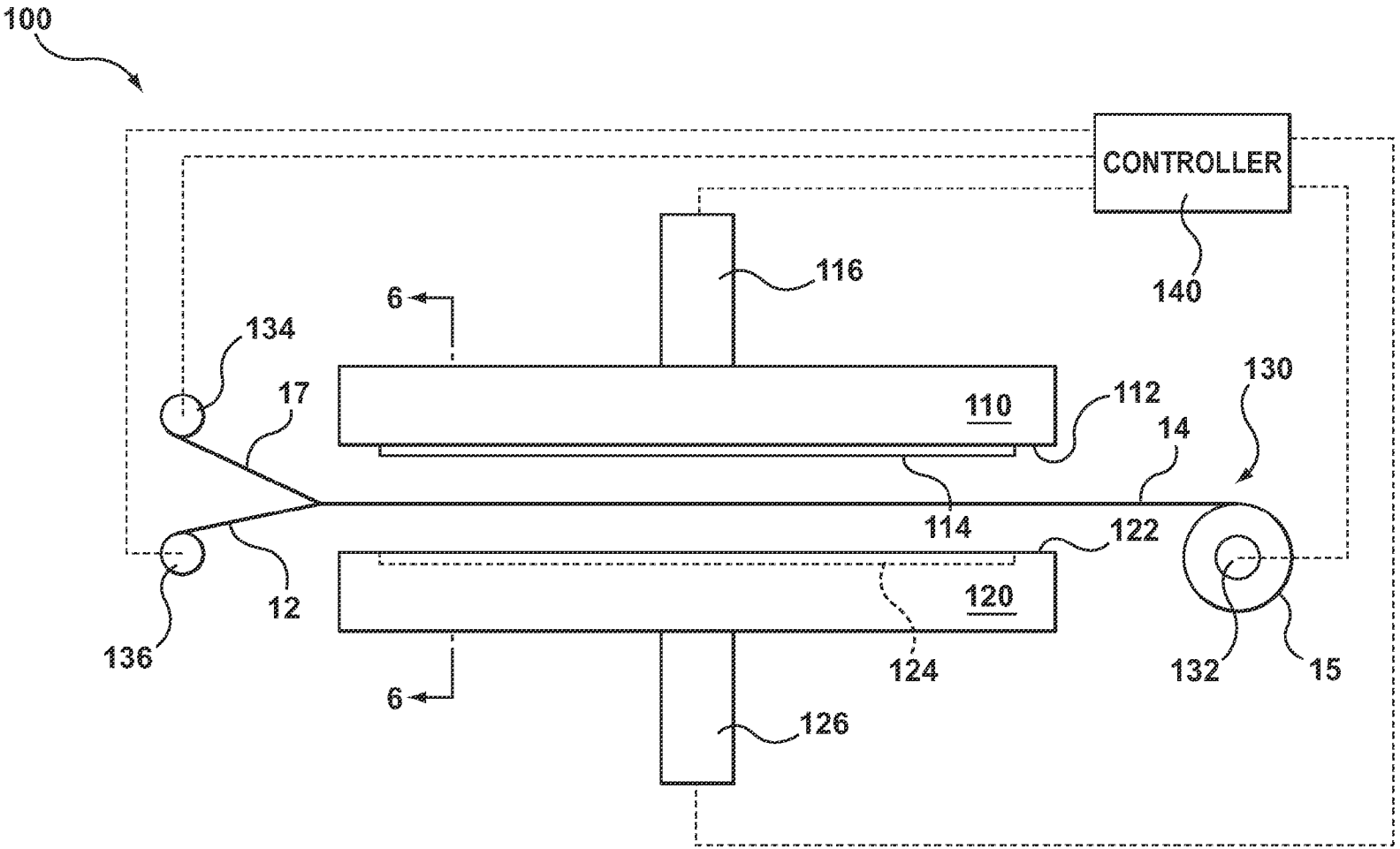
FIG. 4 is a schematic view of an embodiment of an apparatus for forming the wave form of FIG. 2.
Figure 5:
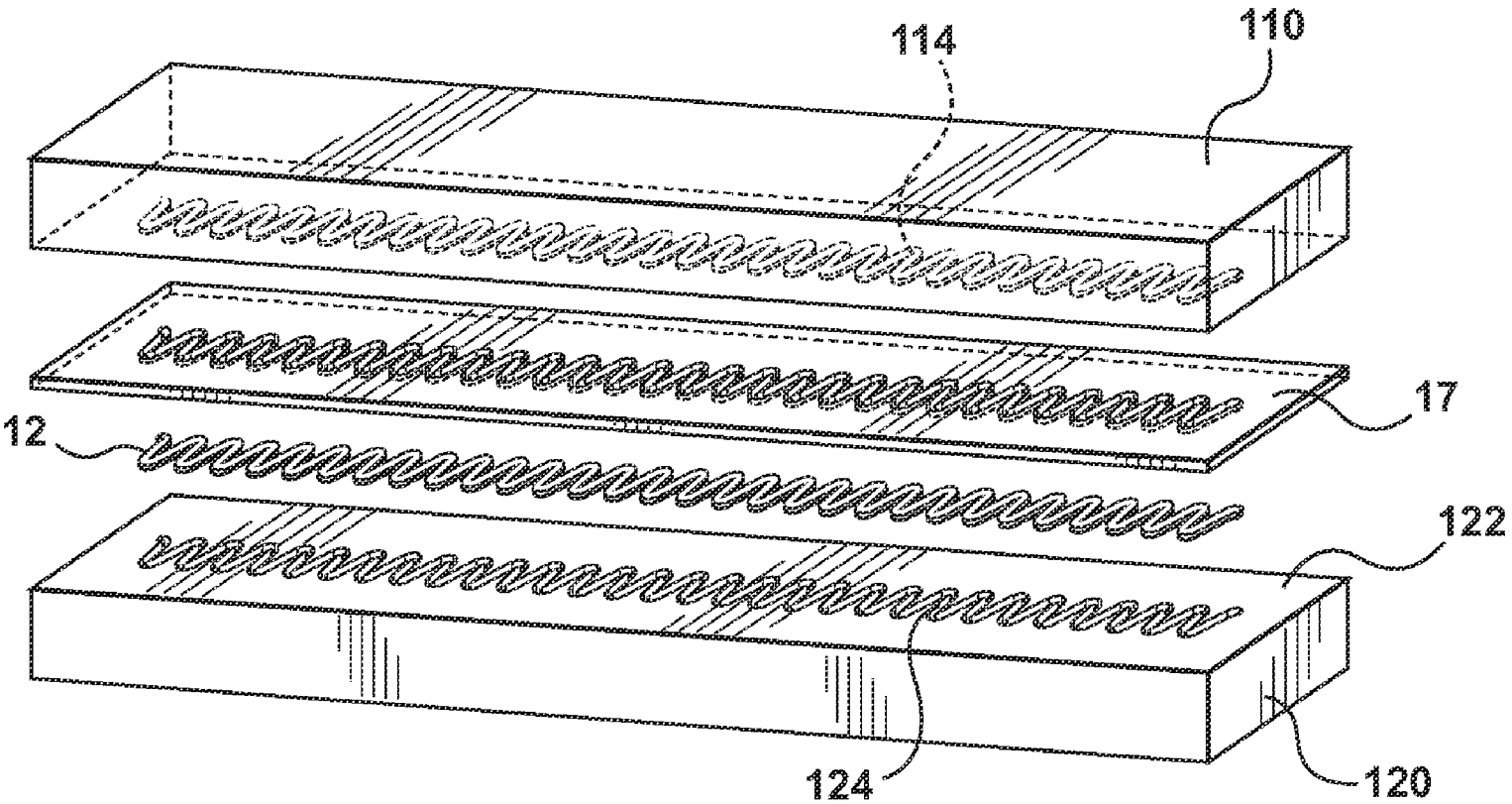
FIG. 5 is a schematic perspective view of a portion of the apparatus of FIG. 4.

FIG. 4 schematically illustrates an embodiment of a forming apparatus 100 that is configured to deform the formable material 14 into a desired shape, such as the wave form 12 illustrated in FIG. 2. The forming apparatus 100 includes a first die 110 and a second die 120. The first die 110 includes a substantially flat surface 112 from which a protrusion 114 extends. As illustrated in FIG. 5, the protrusion 114 is generally in the shape of the wave form 12. The second die 120 includes a substantially flat surface 122 having a recess 124 or groove that is generally in the shape of the wave form 12, and complements the protrusion 114 of the first die 110, as illustrated in FIG. 5. The patterns of the wave forms on the dies 110, 120 may be created by suitable methods known by die manufacturers.

Figure 6B:
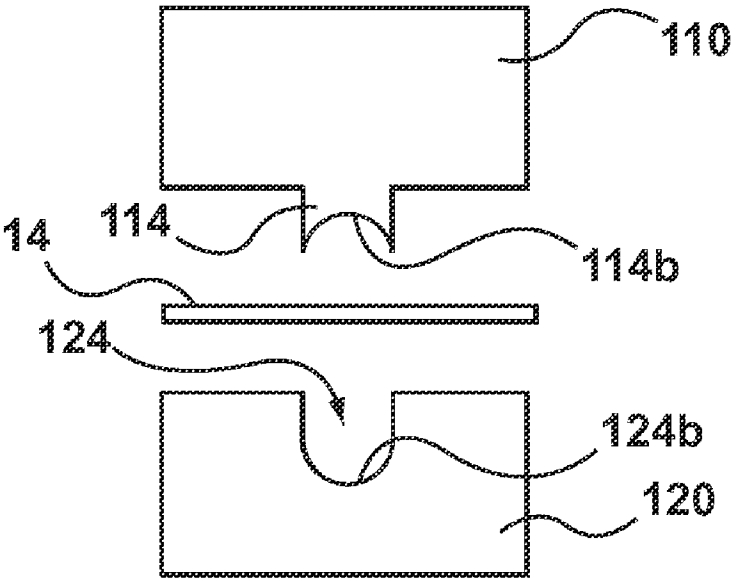
FIGS. 6A and 6B are alternative cross-sectional views of the apparatus of FIG. 4 taken along line 6-6.
Figure 6A:
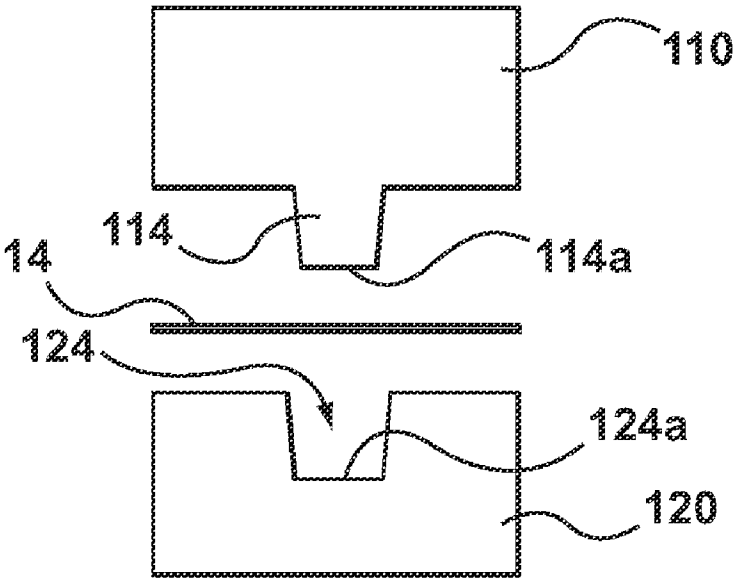

In an embodiment, the protrusion 114 includes at least one straight surface 114*a*, as illustrated in FIG. 6A, and in an embodiment, the protrusion 114 includes a curved surface 114*b*, as illustrated in FIG. 6B. To complement the at least one straight surface 114*a* of the protrusion 114 of the first die 110, the recess 124 includes at least one straight surface 124*a*, as illustrated in FIG. 6A. To complement the curved surface 114*b* of the protrusion 114, the recess 124 includes a curved surface 124*b*, as illustrated in FIG. 6B. The cross-section of the wave form 12 that is formed by the first die 110 and the second die 120 is dependent upon the shapes of the surfaces of the protrusion 114 and the recess 124, as discussed in further detail below.

Returning to FIG. 4, the first die 110 may be connected to a suitable actuator 116 that is configured to move the first die 110 towards the second die 120. The second die 120 may be connected to a suitable actuator 126 that is configured to move the second die 120 towards the first die 110. Movement of the first die 110 towards the second die 120 and/or the second die 120 towards the first die 110 allow the wave form 12 to be stamped from a supply of the formable material 14. The supply of the formable material 14 may be in the form of a roll 15, as illustrated in FIG. 4, or a sheet, as generally illustrated in FIG. 5.

The apparatus 100 may also include a feeder 130 that is configured to feed the formable material 14 to a location between the first die 110 and the second die 120. The feeder 130 may be of any suitable configuration that is configured to deliver the formable material 14 to the location between the first die 110 and the second die 120.

For example, the feeder 130 may include a feed roller 132 that is located at or near one end of the first die 110 and one end of the second die 120, and configured to feed the formable material 14 to a location between the first die 110 and the second die 120, as illustrated in FIG. 4. A take-up roller 134 may be located at or near an opposite end of the first die 110 as the feed roller 132 and configured to wind the spent (or waste) formable material 17. A second take-up roller 136 may be located at or near an opposite end of the second die 120 as the feed roller 132 and configured to wind the wave form 12, as illustrated in FIG. 4.

Figure 7B:
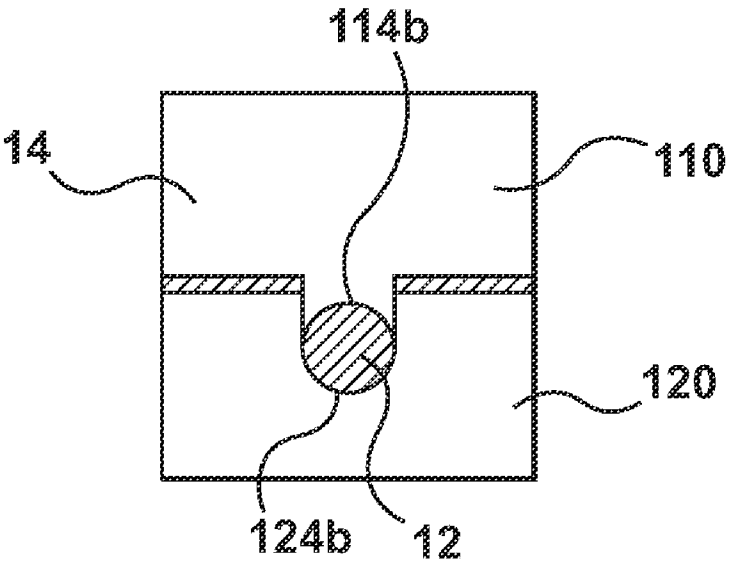
FIGS. 7A and 7B correspond to FIGS. 6A and 6B, after a formable material has been pressed between a first die and a second die.
Figure 7A:
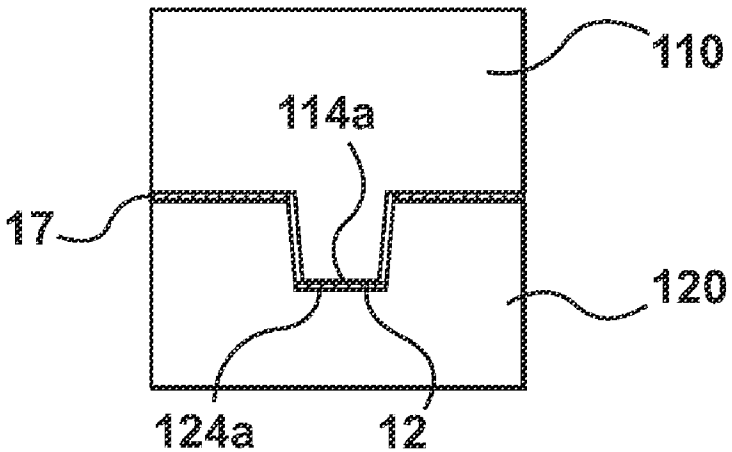

FIGS. 7A and 7B schematically illustrate the stamping, forming, or punching out of the wave form 12 by the movement of the first die 110 towards the second die 120 and/or the movement of the second die 120 towards the first die 110. As appreciated by one of skill in the art, this part of the process may also be termed blanking, coining, piercing, die cutting, or die forming. During such movement of the dies 110, 120, the protrusion 114 of the first die 110 engages one side of the formable material 14, and pushes the formable material 14 into the recess 124 of the second die 120. The protrusion 114 and the recess 124 are configured to generate shear forces on the formable material 14 in a manner that allows the wave form 12 to be sheared and separated from the stock of formable material 14, thereby leaving a spent or waste portion 17 of the formable material, as illustrated in FIG. 5, for example.

The geometry of the protrusion 114 and the recess 124 determine the cross-sectional shape of the wave form 12. For example, in the embodiment illustrated in FIGS. 6A and 7A, the cross-sectional shape of the wave form 12 is rectangular. In the embodiment illustrated in FIGS. 6B and 7B, the cross-sectional shape of the wave form 12 is substantially circular. Any suitable cross-section for the wave form 12 may be created by changing the shapes of the protrusion 114 and the recess 124. The illustrated embodiments are not intended to be limiting in any way. In addition, forging of the stamped wave form 12 may be induced by reducing the clearance between the mating first die 110 and second die 120 to impart compressive forces to modify material strength, ductility, toughness, and grain orientation or the formable material 14.

In another embodiment of the apparatus 100 (not illustrated), the feeder 130 may include a robot that is configured to pick up a sheet of the formable material 14, and place the sheet in the location between the first die 110 and the second die 120. After the wave form 12 has been formed by the first die 110 and the second die 120, the same robot or another robot may remove the wave form 12 and the rest of the sheet (spent portion) 17 of the formable material 14 from the location between the first die 110 and the second die 120.

The actuators 116, 126, and the rollers 132, 134, 136 may be in signal communication with a central controller 140. The controller 140 may be programmed to control movement of the first die 110, the second die 120, and rotation of the rollers 132, 134, 136 so that a plurality of wave forms 12 may be formed in an automated continuous process. Similarly, in the embodiment that uses a robot to feed a sheet of formable material 14 to the location between the first die 110 and the second die 120, the robot may be in signal communication with the controller 140, and the controller may be programmed to control movement of the robot, the first die 110, and the second die 120 so that the plurality of wave forms 12 may be formed in an automated process.

Figure 8:
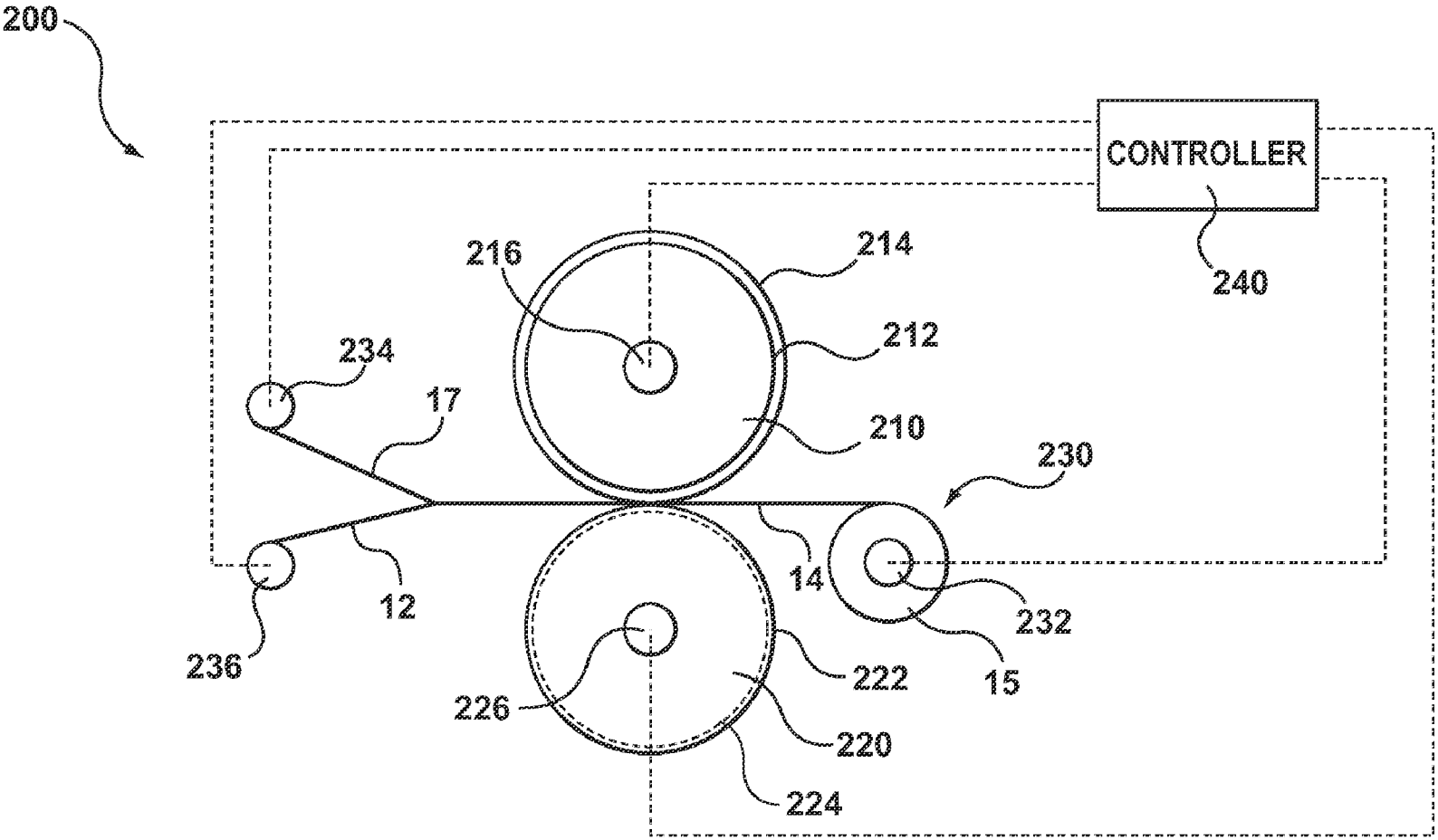
FIG. 8 is a schematic view of an embodiment of an apparatus for forming the wave form of FIG. 2.
Figure 9:
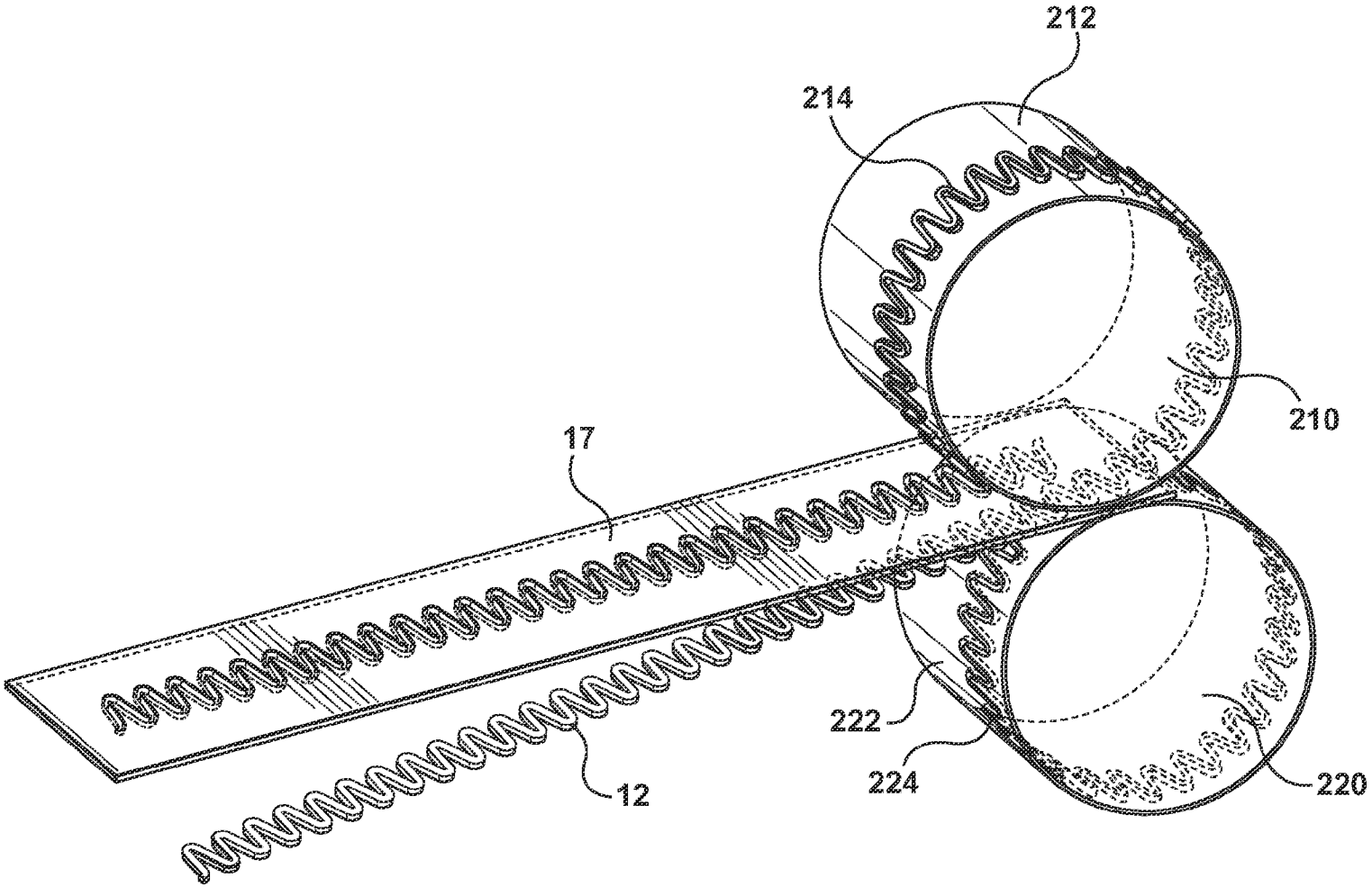
FIG. 9 is a schematic perspective view of a portion of the apparatus of FIG. 7.

FIGS. 8 and 9 illustrate another embodiment of a forming apparatus 200 that is configured to deform the formable material 14 into a desired shape, such as the wave form 12 illustrated in FIG. 2. The forming apparatus 200 includes a first die 210 and a second die 220. The first die 210 is in the form of a roller and includes a curved surface 212 from which a protrusion 214 extends. As illustrated in FIG. 9, the protrusion 214 is generally in the shape of the wave form 12. The second die 220 is also in the form of a roller and includes a curved surface 222 having a recess 224 or groove that is generally in the shape of the wave form 12, and complements the protrusion 214 of the first die 210. The protrusion 214 may have substantially the same cross-section as embodiments of the protrusion 114 illustrated in FIGS. 6A and 6B. Similarly, the recess 224 may have substantially the same cross-section as the embodiments of the recess 224 illustrated in FIGS. 6A and 6B, although the illustrated embodiments are not intended to be limiting in any way.

The first die 210 may be operatively connected to a suitable drive 216 that is configured to rotate the first die 210, and the second die 220 may be operatively connected to a suitable drive 226 that is configured to rotate the second die 220. The drives 216, 226 may include motors, for example. The first die 210 is positioned relative to the second die 220 such that the protrusion 214 of the first die 210 is received by the recess 224 of the second die 220. As the formable material 14 is fed to a location between the first die 210 and the second die 220, the rotational movement of the dies 210, 220 will be such that the dies 210, 220 will pull the formable material 14 from one side of the dies 210, 220, and push the wave form 12 and spent material 17 out the other side of the dies 210, 220, as illustrated in FIG. 8.

The apparatus 200 may also include a feeder 230 that is configured to feed the formable material 14 to the location between the first die 210 and the second die 220. The feeder 230 may be of any suitable configuration that is configured to deliver the formable material 14 to the location between the first die 210 and the second die 220.

For example, the feeder 230 may include a feed roller 232 that is located at or near one side of the first die 210 and one side of the second die 220, and configured to feed the formable material 14 between the first die 210 and the second die 220, as illustrated in FIG. 8. A take-up roller 234 may be located at or near an opposite side of the first die 210 as the feed roller 232, and configured to wind the spent formable material 17. A second take-up roller 236 may be located at or near an opposite side of the second die 220 as the feed roller 232 and configured to wind the wave form 12, as illustrated in FIG. 8.

In another embodiment of the apparatus 200 (not illustrated), the feeder 230 may include a robot that is configured to pick up a sheet of the formable material 14, and place a lead end of the sheet in the location between the first die 210 and the second die 220 so that the first die 210 and the second die 220 grab the lead end of the sheet of the formable material 14 and move the sheet of material through the location via the rotary motions of the first die 210 and the second die 220. The same robot or another robot may be used to grasp the wave form 12 and the spent portion of the sheet of formable material 17 upon their exit from the location between the first die 210 and the second die 220. The illustrated embodiments are not intended to be limiting in any way.

The drivers 216, 226 and roller 232, 234, 236 may be in signal communication with a central controller 240 that may be programmed to control rotation of the first die 210 and the second die 220, as well as the rollers 232, 234, 236 so that a continuous of wave form 12, which may be later separated into a plurality of shorter wave forms, or a plurality of wave forms may be formed in an automated process. Similarly, in the embodiment that uses a robot to feed a sheet of formable material 14 to the location between the first die 210 and the second die 220, the robot may be in signal communication with the controller 240, and the controller may be programmed to control movement of the robot, and rotation of the first die 210, and the second die 220 so that the plurality of wave forms 12 may be formed in an automated process.

Embodiments of the stents made using the method and apparatus discussed above may be formed from a sheet, roll, or strip of suitable material. Suitable materials for the stent include but are not limited to stainless steel, iridium, platinum, gold, tungsten, tantalum, palladium, silver, niobium, zirconium, aluminum, copper, indium, ruthenium, molybdenum, niobium, tin, cobalt, nickel, zinc, iron, gallium, manganese, chromium, titanium, aluminum, vanadium, and carbon, as well as combinations, alloys, and/or laminations thereof. For example, the stent may be formed from a cobalt alloy, such as L605 or MP35N®, Nitinol (nickel-titanium shape memory alloy), ABI (palladium-silver alloy), Elgiloy® (cobalt-chromium-nickel alloy), etc. It is also contemplated that the stent may be formed from two or more materials that are laminated together, such as tantalum that is laminated with MP35N®. The stents may also be formed from sheets, rolls, or strips of material having layers of different metals, alloys, or other materials. Embodiments of the stent may also be formed from hollow material that has been filled with other materials. The aforementioned materials and laminations are intended to be examples and are not intended to be limiting in any way.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient roadmap for implementing an exemplary embodiment of the invention, it being understood that various changes may be made in the function and arrangement of members described in an exemplary embodiment without departing from the scope of the invention as set forth in the appended claims.

What is claimed is:

1. A method for forming a wave form for a stent, the wave form comprising a plurality of substantially straight portions and a plurality of curved portions, each curved portion connecting adjacent substantially straight portions, the method comprising:

feeding a formable material between a first die and a second die, the first die having a protruding surface in the shape of the wave form, and the second die having a recessed surface in the shape of the wave form complementing the protruding surface of the first die;

pressing the formable material with the protruding surface of the first die into contact with the recessed surface of the second die; and shearing the wave form from the formable material with shearing forces created by said pressing.

2. The method according to claim 1, wherein at least a portion of the protruding surface is curved.

3. The method according to claim 1, wherein at least a portion of the recessed surface is curved.

4. The method according to claim 1, wherein at least a portion of the protruding surface is straight.

5. The method according to claim 4, wherein at least a portion of the recessed surface is straight.

6. The method according to claim 1, wherein said pressing comprises moving the first die towards the second die and/or moving the second die towards the first die.

7. The method according to claim 1, wherein said pressing includes rotating the first die in a first direction and rotating the second die is a second direction opposite the first direction.

8. The method according to claim 7, wherein said feeding and said pressing is continuous.

9. The method according to claim 1, wherein the formable material is a sheet of material.

10. A method of manufacturing a stent, the method comprising:

forming a wave form for a stent, the wave form comprising a plurality of substantially straight portions and a plurality of curved portions, each curved portion connecting adjacent substantially straight portions, said forming comprising feeding a formable material between a first die and a second die, the first die having a protruding surface in the shape of the wave form, and the second die having a recessed surface in the shape of the wave form complementing the protruding surface of the first die;

pressing the formable material with the protruding surface of the first die into contact with the recessed surface of the second die; and shearing the wave form from the formable material with shearing forces created by said pressing;

wrapping the wave form around a mandrel at an angle to form a helix comprising a plurality of turns; and connecting selected curved portions of the wave form in adjacent turns of the helix.

11. The method according to claim 10, wherein said connecting comprises fusing the selected curved portions together.

12. The method according to claim 10, wherein said connecting comprises welding the selected curved portions together.

13. The method according to claim 10, wherein said pressing comprises moving the first die towards the second die and/or moving the second die towards the first die.

14. The method according to claim 10, wherein said pressing includes rotating the first die in a first direction and rotating the second die is a second direction opposite the first direction.

15. The method according to claim 14, wherein said feeding and said pressing is continuous.

16. The method according to claim 10, wherein the formable material is a sheet of material.

* * * * *

UNITED STATES PATENT AND TRADEMARK OFFICE

CERTIFICATE OF CORRECTION

PATENT NO. : 8,328,072 B2
APPLICATION NO. : 12/838778
DATED : December 11, 2012
INVENTOR(S) : Goshgarian et al.

It is certified that error appears in the above-identified patent and that said Letters Patent is hereby corrected as shown below:

In the Claims:

Column 6, Claim 7, line 60

"…second die is a second…"

should be changed to

--second die in a second-- and

Column 8, Claim 14, line 12

"…second die is a second…"

should be changed to

--second die in a second--

Signed and Sealed this
Thirtieth Day of July, 2013

Teresa Stanek Rea
*Acting Director of the United States Patent and Trademark Office*